United States Patent [19]

Kinoshita et al.

[11] 4,400,949

[45] Aug. 30, 1983

[54] FROST DETECTOR FOR REFRIGERATING APPARATUS

[75] Inventors: Minoru Kinoshita, Nagasaki; Yoshio Sasaki, Nishisonogi, both of Japan

[73] Assignee: Mitsubishi Denki Kabushiki Kaisha, Tokyo, Japan

[21] Appl. No.: 352,874

[22] Filed: Feb. 26, 1982

[30] Foreign Application Priority Data

Mar. 3, 1981 [JP] Japan ..... 56-30913

[51] Int. Cl.[3] ..... F25D 21/02

[52] U.S. Cl. ..... 62/140; 62/156

[58] Field of Search ..... 62/140, 154, 156, 128; 55/274, DIG. 34

[56] References Cited

U.S. PATENT DOCUMENTS 4,040,042 8/1977 Mayer ..... 55/274
4,104,888 8/1978 Reedy et al. ..... 62/140
4,299,095 11/1981 Cassarino ..... 62/156

FOREIGN PATENT DOCUMENTS 54-24344 2/1979 Japan ..... 62/156
55-143346 11/1980 Japan ..... 62/128

*Primary Examiner*—Albert J. Makay
*Assistant Examiner*—Harry Tanner
*Attorney, Agent, or Firm*—Wenderoth, Lind & Ponack

[57] ABSTRACT

A frost deposition detector for an air cooler disposed in a refrigerating chamber. A first signal is generated when the electric current flowing through the motor of the air blower for the air cooler, the value of which is adjusted with respect to the voltage variation across the motor and the air temperature change in the refrigerating chamber, reaches a threshold value which is proportional to the initial current value corresponding to the state of no frost deposition. A second signal is generated when the difference between the air temperature in the chamber and the air cooler temperature reaches a threshold difference, which can be set at a desired level. The detector generates a defrostor activation signal when and only when both first and second command signals are generated.

9 Claims, 5 Drawing Figures

FROST DETECTOR FOR REFRIGERATING APPARATUS

BACKGROUND OF THE INVENTION

1. Field of the Invention

This invention relates to frost detectors for refrigerating apparatuses, and more particularly to frost detectors which detect the deposition of frost on the air coolers disposed in the refrigerator chambers and generate signals for starting the defrosting operation.

2. Description of the Prior Art

In the course of operation of an refrigerating apparatus, frost tends to deposit on the air cooler disposed in the refrigerator chamber which stores fresh foods, etc. The air cooler usually comprises the pipes or finned coils in which the refrigerant evaporates and deprives heat therefrom, and the air blower which blows air past the pipes or finned coils and circulates the cooled air in the refrigerator chamber. Alternatively, brine may be used as the medium flowing through the pipes of the air cooler to deprive heat therefrom, the brine being cooled in a heat exchanger disposed in the evaporator of a refrigerating device.

Thus, when frost deposits on the air cooler, the air cooling ability and effectivity of the cooler drops, necessitating occasional defrosting thereof. The defrosting is effected by energizing a heater, or by spraying water from a spray nozzle, or by blowing hot gas past the coils.

Thus, it is desirable to provide the air cooler with a frost detector which detects the deposition of the frost on the air cooler and generates a signal for energizing the defroster. A conventional method of detecting the frost deposition has been based on the fact that the electric current flowing through the electric motor of the air blower increases as the frost accumulates on the air cooler. Thus, a conventional frost detector comprised a current detector which detects the current I flowing through the air blower of the air cooler, and a comparator which compares the value of the detected current with a predetermined fixed value $I_1$ and generates a defroster activating signal when the detected value exceeds the fixed predetermined value $I_1$.

This type of frost detector, however, has not been wholely immune to errors:

(1) The air blower current I, or the electric current flowing through the motor of the air flower, depends not only on the amount F of deposited frost, but also on the temperature T of the air within the refrigerator chamber. Thus, the timing of the defroster activating signal depends on the temperature of the air T, as well as on the amount of frost F.

(2) The air blower current I also depends on the voltage V applied on the air flower motor. Thus, the variation or fluctuation in the voltage V of the electric power source for the air blower may also cause the misfunction of the frost detector.

(3) When the path of the air flow is blocked by a big rubbish, for example, the air blower current I is affected and an erroneous signal may be generated.

(4) Gradual deterioration in the performance of the bearings of the air blower causes an increase in the mechanical load thereof, which in its turn causes the air blower current I to increase.

The alternative method of detecting the accumulation of frost on the air cooler relied on the fact that, as the frost accumulates on the pipes or finned coils of the air cooler, the difference between the temperature T of the air in the refrigerating chamber and the temperature S of pipes or coils increases. Thus, an other type of conventional frost detector comprises temperature detectors detecting the temperatures T and S of the air in the refrigerating chamber and of the air cooler respectively, and generates a defroster activating signal when the difference (T−S) in the detected temperatures T and S exceeds a predetermined fixed value $\alpha$.

This type of conventional frost detector was not immune to errors, either:

(5) The opening of the door of the refrigerating chamber momentarily raises the temperature T of the air therein, and thus may trigger the detector to generate an erroneous defroster activating signal.

(6) The low pressure of the refrigerant within the pipes or coils during the starting of the refrigerating system may also cause the misfunction of the frost detector.

(7) The refrigerant gas leakage in the refrigerating system also causes the pressure to decrease, which is a possible factor in bringing about the misfunction of the detector, as above.

SUMMARY OF THE INVENTION

Thus, an object of the invention is to provide an improved frost detector for an air cooler disposed in a refrigerating chamber of a refrigerating apparatus, which detects the accumulation of frost on the air cooler and generates a defrostor activation signal when the amount of frost reaches a predetermined level.

A further object of the invention is to provide a frost detector which generates the defrostor activation signal in an accurate timing when the amount of the deposited frost reaches a predetermined level.

A still further object of the invention is to provide a frost detector which is immune to the causes of errors of conventional frost detectors as listed above.

The air cooler which may be provided with the frost detector according to the present invention includes piping means through which a medium flows depriving heat therefrom, air blower for circulating air in the refrigerating chamber past said piping means, an electric motor which drives said air blower and a defrostor means for removing frost deposited on said piping means.

The frost detector according to the present invention comprises an air temperature detector for detecting the temperature T° C. of the air in the refrigerating chamber, and for generating an air temperature signal corresponding to the air temperature T° C., and a piping temperature detector for detecting the temperature S° C. of the piping means of the air cooler, and for generating a piping temperature signal corresponding to the piping temperature S° C. The frost detector further comprises a current detector for detecting the current I flowing through said electric motor of the air cooler, and for generating a current signal corresponding to said current I, and a voltage detector for detecting the voltage V developped across the electric motor of the air blower, and for generating a voltage signal corresponding to the voltage V. The memory connected to the air temperature detector, the current detector, and the voltage detector, memories the value $T_o$ of the air temperature T at the time point just after the completion of a defrosting operation of the defrostor of the air cooler, the value $I_o$ of the current I at the same time point, and the value $V_o$ of the voltage V at the same time point. The ratio settor sets and memorizes a ratio K, and the temperature difference settor sets and memorizes a temperature difference $\alpha$° C. Further, the calculator connected to the air temperature detector, the current detector, the voltage detector, the memory, and the ratio settor, continuously determines whether or not the relation $I_o \times K \leqq I \times (V/V_o) \times (273+T)/(273+T_o)$ holds, and generaies a first signal when said relation $I_o \times K \leqq I \times (V/V_o) \times (273+T)/(273+T_o)$ holds. The calculator further connected to the air temperature detector, the piping temperature detector, and the temperature difference settor, calculates the temperature difference (T−S), and compares the value $\alpha$ with said temperature difference (T−S), the calculator generating the second signal when $\alpha \leqq (T-S)$ holds. The calculator generates a defroster activation signal for activating the defrostor when both said first and second signals are generated.

In case where the air cooler comprises an expansion valve upstream the piping means in which the refrigerant medium evaporates and deprives heat from the piping means, the piping temperature detector preferably detects the temperature S of the liquid refrigerant at the outlet portion of the expansion value.

Thus, the first signal is generated when the adjusted current value $I \times (V/V_o) \times (273+T)/(273+T_o)$, which is adjusted with respect to the voltage and the air temperature variation, reaches $I_o \times K$, in stead of a fixed predetermined value. Further, the defrostor activation signal is generated only when both the first and the second signals are generated, which mimimizes the chance of erroneous defroster activation signals.

BRIEF DESCRIPTION OF THE DRAWINGS

Further advantages, principles, and the structure of the present invention will become more apparent from the following detailed description of the preferred embodiments taken in conjunction with the accompanying drawings, in which.

In the drawings, like reference numerals or characters represent like parts or quantities.

DETAILED DESCRIPTION OF THE PREFERRED EMBODIMENTS

Figure 1:
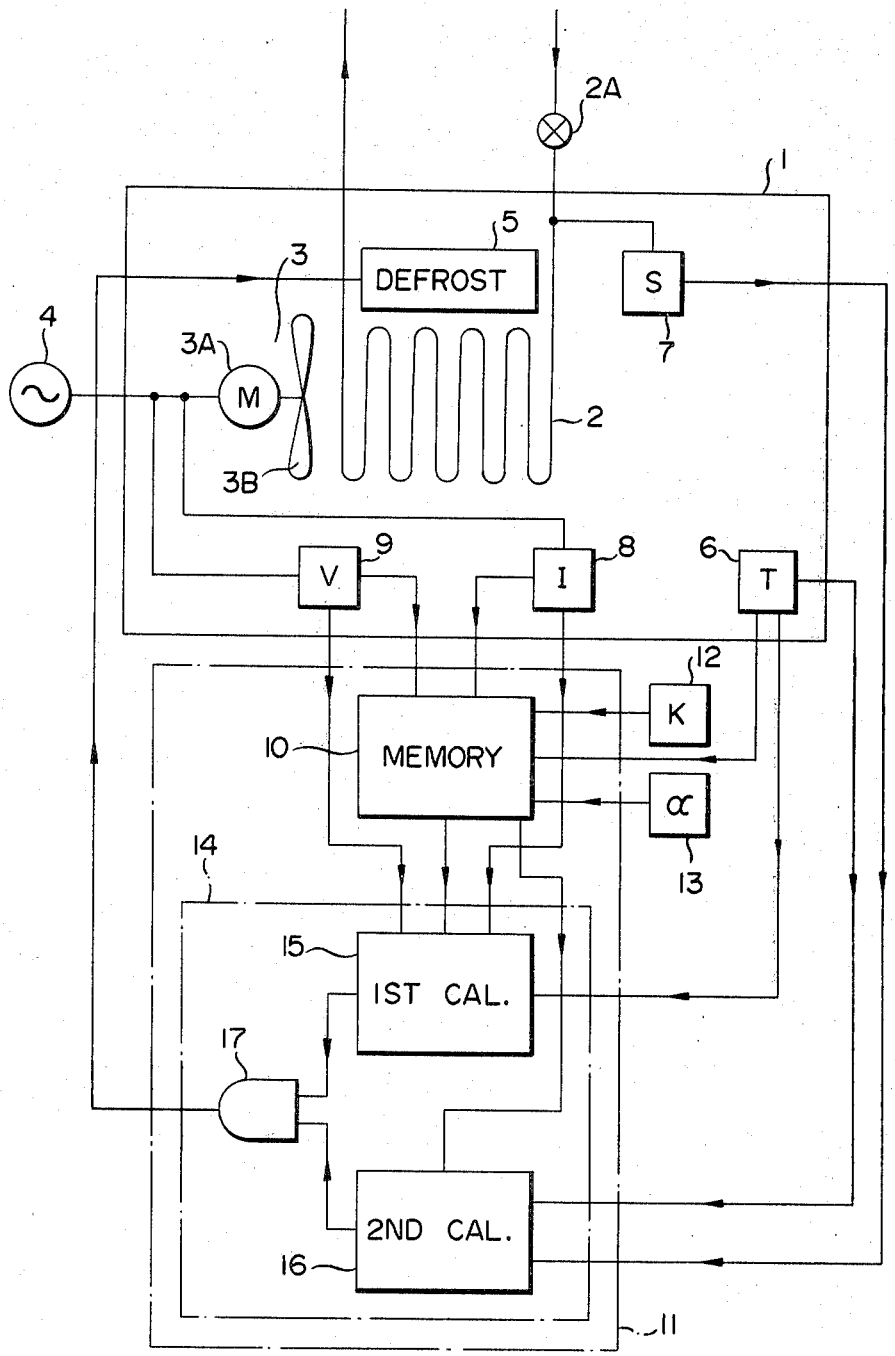
FIG. 1 shows a block diagram of one embodiment o the frost detector according to the present invention, together with a schematic view of an air cooler to which the embodiment is attached.

Referring now to FIG. 1 of the drawings, an embodiment of the frost detector according to the present invention is described together with an air cooler which is disposed in a refregerating chamber and of which the frost detector detects the accumulation of frost.

An air cooler to which the frost detector according to the present invention is attached is disposed in a refregerating chamber 1 in which fresh foods, etc., are stored. The air cooler comprises a pipe or finned coil 2 through which a medium flows depriving heat therefrom, and an air blower 3 comprising an electric motor 3A and a fan 3B driven by the motor 3A electrically coupled to an electric power source 4. The air cooler also comprises a defroster 5 which may be an electric heater, or a shower nozzle from which water is sprayed onto the coil or piping means 2, or hot gas blower which blows hot gas past the coils or piping means 2. In the case of the air cooler shown in FIG. 1, the medium flowing through the coil 2 is the refrigerant medium which is compressed by the compressor (not shown) and liquidized in the condensor (not shown). Thus, the refrigerant in liquid form which have passed through the expansion valve 2A disposed upstream the coil 2 evaporates in the coil 2 and deprives evaporation heat therefrom. Alternatively, the medium flowing through the coil 2 may be the brine which is cooled in a heat exchanger (not shown) of a refrigerating system. The fan 3B of the air blower 3 blows air through the cooled coil 2, and circulates the cooled air in the refrigerating chamber 1.

The frost detector comprises an air temperature detector 6 detecting the air temperature T° C. in the refrigerating chamber 1, and an air cooler temperature or piping temperature detector 7 detecting the temperature S° C. of the coil 2, in this case, the temperature S of the liquid refrigerant at the outlet portion of the expansion valve 2A. The air temperature detector 6 and the piping temperature detector 7 generate the air temperature signal and the piping temperature signal corresponding to the temperature T and S respectively. The frost detector also comprises a current detector 8 detecting the electric current I flowing through the electric motor 3A and generating a current signal corresponding thereof, and a voltage detector 9 detecting the voltage V applied across the electric motor 3A and generating a voltage signal corresponding thereof.

The memory 10 of the computing device 11 is connected with the air temperature detector 6, the current detector 8, and the voltage detector 9, and memorizes the initial values $T_o$, $I_o$, and $V_o$ of the air temperature T, the current I, and the voltage V, respectively, at the time point just after the completion of the defrosting operation of the defrostor 5.

A ratio settor 12 and a temperature difference settor 13 are also connected to the memory 10, and feed a ratio K and a temperature difference threshould $\alpha$° C., respectively, into the memory, which can be set at arbitrary desired values. Thus the memory 10 also memorized the ratio K and the temperature difference threshould $\alpha$° C.

The first calculator 15 is connected with the voltage detector 9, the current detector 8, the air temperature detector 6, and the memory 10, and continuously calculates the threshould value $I_o \times K$ or the product of the ratio K and the initial value $I_o$ of the current I, and the adjusted current value $I \times (V/V_o) \times (273+T)/(273+T_o)$, and determines whether or not the relation $I_o \times K \leqq I \times (V/V_o) \times (273+T)/(273+T_o)$ holds. The values V, I, and T are continuously supplied from the voltage detector 9, the current detector 8, and the air temperature detector 6, respectively, as the voltage, current, and air temperature signals, and the values $V_o$, $I_o$, $T_o$, and K are supplied from the memory 10. Alternatively, the first calculator 15 calculates the value $(I/I_o)\times(V/V_o)\times(273+T)/(273+T_o)$ and determines whether or not the relation $K\leqq(I/I_o)\times(V/V_o)\times(273+T)/(273+T_o)$ holds. In these calculations the air temperatures T and $T_o$ have been supposed to be measured in centigrade scale, and thus the values (273+T) and (273+T) corresponds to the absolute temperature of the air in the refrigerating chamber 1. The first calculator generates a first signal when the relation $I_o\times K\leqq I\times(V/V_o)\times(273+T)/(273+T_o)$ or $K\leqq(I/I_o)\times(V/V_o)\times(V/V_o)\times(273+T)/(273+T_o)$ holds.

The second calculator 16 is connected with the current detector 8, the air temperature detector 6, the piping temperature detector 7, and the memory 10, and continuously calculates the temperature difference (T−S), and determines whether or not this temperature difference (T−S) has reached the temperature difference threshold $\alpha$, i.e., whether or not the relation $\alpha\leqq(T-S)$ hold. The value $\alpha$ is inputted from the memory 10, and the values T and S are supplied from the air temperature detector 6 and the piping temperature detector 7, respectively, as the air temperature and the piping temperature signals. The second calculator 16 generates the second signal when the temperature difference (T−S) reaches the temperature difference threshold $\alpha$, i.e., when the relation $\alpha\leqq(T-S)$ is satisfied.

The third calculator 17, which constitutes the calculator means 14 of the computing device 11 together with the first and the second calculator 15 and 16, is connected with the first and the second calculator 15 and 16, and generates the defrostor activation signal when both the first and the second signals are supplied thereto from the first and the second calculators 15 and 16.

The defrostor 5, which is connected with the third calculator 17 of the calculating means 14 of the computing device 11, is activated by the defrostor activation signal generated by the third calculator 17, and removes the frost accumulated on the coil 2 of the air cooler to which the frost detector according to the present invention is attached.

Figure 2:
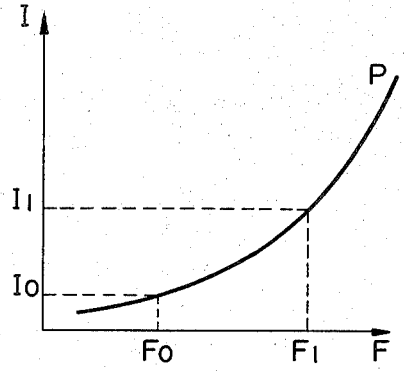
FIG. 2 shows a frost-current characteristic curve representing the relationship between the amount of frost deposited on the air cooler and the electric current flowing through the motor of the air blower of the air cooler.
Figure 5:
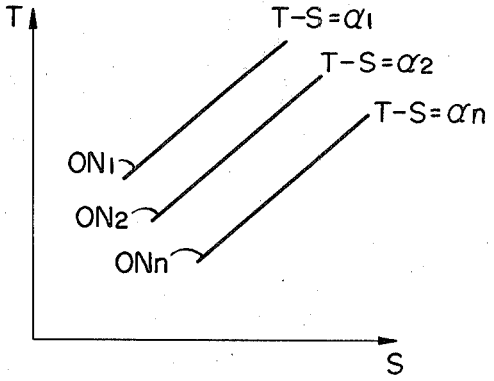
FIG. 5 shows a plurality of curves in the air temperature-piping temperature plane, which correspond to different threshold temperature differences between the air temperature and the piping temperature.

Referring now to FIGS. 2 and 5 of the drawings, the principles of the operation of frost detector of the present invention are described.

As shown in FIG. 2, the electric current I flowing through the electric motor 3A of the air blower 3 of the air cooler increases as the amount F of the frost deposited on the air cooler increases, along an F-I characteristic curve P. Thus, just after the completion of a defrosting operation of the defrostor 5, the amount of frost F is equal to a negligible amount $F_o$ and the current equal to the value $I_o$ flows through the air flower motor 3A. As the amount of frost F gradually increases to a predetermined amount $F_1$, at which it is desirable to effect the defrosting operation, the current I reaches the value $I_1$. Thus, in conventional frost detectors in which the current I flowing through the air blower motor 3A is used as the index of frost accumulation for the purpose of detecting the frost, the defrostor activation signal was generated when a signal threshold current value $I_1$ was reached.

Figure 3:
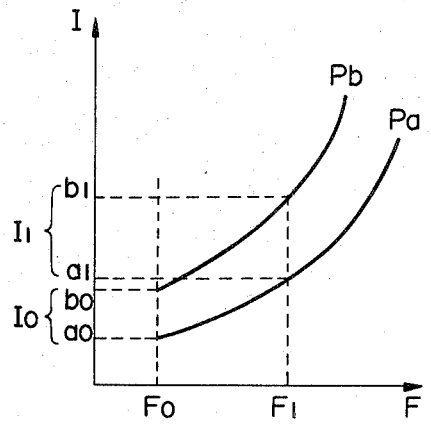
FIG. 3 shows the dependance of the frost-current characteristic curve upon the initial value of the current flowing through the motor of the air blower.

As shown in FIG. 3, however, the initial current value $I_o$, which flows through the air blower motor 3A when the amount of frost F is equal to $F_o$, may vary from $a_o$ to $b_o$ as the characteristic of the motor 3A, the air blower 3, and the ventilating duct (not shown) changes. Thus, as the amount of the frost F increases, the current I increases along the characteristic curve $P_a$ or $P_b$, as the case may be, and the current value $I_1$, which flows through the air blower motor 3A when the amount F reaches $F_1$, may also vary from $a_1$ to $b_1$. Thus, it is desirable to use a threshold value $I_o\times K$ which changes in proportion to the initial current value $I_o$. Further, as the F-I characteristic curve may be fluctuated or varied with the fluctuation or variation of the voltage V across the motor 3A or of the air temperature in the refrigerating chamber 1 even when the initial current $I_o$ is fixed, it is desirable to use the adjusted current value $I\times(V/V_o)\times(273+T)/(273+T_o)$ instead of the current I, which is adjusted with respect to the voltage V across the electric motor 3A of the air blower 3, and the air temperature T in the chamber 1. Thus, according to the principle of the present invention, the adjusted current value $I\times(V/V_o)\times(273+T)/(273+T_o)$ is compared to the variable threshold value $I_o\times K$, and the first signal is generated by the first calculator 15 when $I_o\times K\leqq I\times(V/V_o)\times(273+T)/(273+T_o)$ holds.

Figure 4:
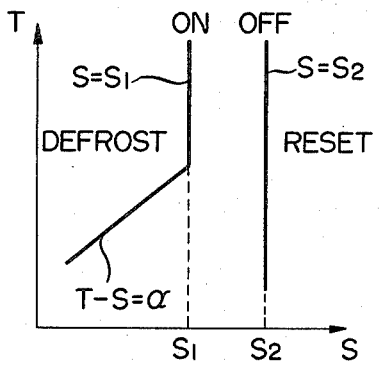
FIG. 4 shows a possible form of defrost and reset domains in the air temperature-piping temperature plane.

The air temperature T in the refrigerating chamber 1 tends to increase compared to the piping temperature S when amount F of frost increases. Thus, the temperature difference (T−S) increases as the amount of frost F increases, and reaches a value $\alpha$ when the amount F reaches $F_o$. Thus, as shown in FIG. 4, it is possible to generate a second signal when the point (S, T) in the S−T plane falls on the line ON or goes into the domain DEFROST.

The temperature difference $\alpha$, however, may vary, with the variation in the characteristic of the air cooler, in the range from $\alpha_1$ to $\alpha n$ as shown in FIG. 5. Thus, it is preferable to generate the second signal when the temperature difference (T−S) reaches or exceeds a variable temperature difference threshold value $\alpha$, which may vary from $\alpha_1$ to $\alpha_n$, which can be set at an arbitary value.

Further, as the defrostor activation signal is generated when and only when both the first and second signals are generated, the chance of generating an erroneous defrostor activation signal is minimized.

What is claimed is:

1. A frost detector for detecting a deposition of frost on an air cooler disposed in a refrigerating chamber, and for generating a defrostor activation signal when the amount of the deposition of frost reaches a predetermined level, said air cooler including piping means through which a medium flows depriving heat therefrom, air blower means for circulating air in said chamber past said piping means, and electric motor which drives said air blower means, and a defrostor means for removing frost deposited on said piping means, said frost detector comprising:

air temperature detector means disposed in said chamber for detecting the temperature T° C. of the air in said chamber, and for generating an air temperature signal corresponding to the air temperature T° C.;

piping temperature detector means disposed at said piping means for detecting the temperature S° C. of said piping means, and for generating a piping temperature signal corresponding to the piping temperature S° C.;

current detector means for detecting the current I flowing through said electric motor of said air cooler, and for generating a current signal corresponding to said current I;

voltage detector means for detecting the voltage V developed across said electric motor of the air blower, and enerating a voltage signal corresponding to said voltage V;

memory means connected with said air temperature detector means, said current detector means, and said voltage detector means, for memorizing a value $T_o$ of said air temperature T at a time point just after a completion of a defrosting operation of said defrostor, a value $I_o$ of said current I at said time point, and a value $V_o$ of said voltage V at said time point;

ratio setting means for setting and memorizing a ratio K;

temperature difference setting means for setting and memorizing a temperature difference threshold value $\alpha$° C.;

first calculator means connected with said air temperature detector means, said current detector means, said voltage detector means, said memory means, and said ratio setting means, for continuously determining whether or not the relation $I_o \times K \leqq I \times (V/V_o) \times (273+T)/(273+T_o)$ holds, said first calculator means including means for generating a first signal when said inequality $I_o \times K \leqq I \times (V/V_o) \times (273+T)/(273+T_o)$ holds;

second calculator means connected with said air temperature detector means, said piping temperature detector means, and temperature difference setting means, for calculating the temperature difference (T−S), and for comparing said value $\alpha$ with said temperature difference (T−S), said second calculator means including means for generating a second signal when $\alpha \leqq (T-S)$ holds;

a third calculator means connected with said first and second calculator means, responsive to said first and second signals, for generating a defrostor activation signal for activating said defrostor means when both said first and second signals are generated.

2. A frost detector as claimed in claim 1, for detecting a deposition of frost on the air cooler disposed in a refrigerating chamber and for generating a defrostor activation signal when the amount of the deposition of frost reaches a predetermined level, said air cooler including piping means through which a medium flows and deprives heat from the piping means, an expansion valve upstream of said piping means, air blower means for circulating air in said chamber past said piping means, an electric motor which drives said air blower means, and a defrostor means for removing frost deposited on said piping means wherein said piping temperature detector means includes means for detecting the temperature S° C. of said medium at an outlet portion of said expansion valve.

3. A frost detector as claim in 1 or 2, wherein said first calculator means includes means for calculating the product $I_o \times K$ and the adjusted current value $I \times (V/V_o) \times (273+T)/(273+T_o)$, means for comparing said product and said adjusted current value, and means for generating the first signal when relation $I_o \times K \leqq I \times (V/V_o) \times (273+T)/(273+T_o)$ holds.

4. A frost detector as claimed in claim 1 or 2, wherein said first calculator means includes means for calculating $(I/I_o) \times (V/V_o) \times (273+T)/(273+T_o)$, means for comparing said ratio K with $(I/I_o) \times (V/V_o) \times (273+T)/(273+T_o)$, and means for generating the first signal when the relation $K \leqq (I/I_o) \times (V/V_o) \times (273+T)/(273+T_o)$ holds.

5. A frost detector for detecting a deposition of frost on an air cooler disposed in a refrigerating chamber amount of the deposition of frost reaches a predetermined level, said air cooler including piping means through which a medium flows depriving heat therefrom, air flower means for circulating air in said chamber past said piping means, an electric motor which drives said air flower means, and a defrostor means for removing frost deposited on said piping means, said frost detector comprising:

air temperature detector means for detecting the temperature T° C. of the air in said chamber, and for generating an air temperature signal corresponding to the air temperature T° C.;

piping temperature detecting means for detecting the temperature S° C. of said piping means, and for generating a piping temperature signal corresponding to the piping temperature S° C.;

current detector means for detecting the current I flowing through said electric motor of said air cooler, and for generating a current signal corresponding to said current I;

voltage detector means for detecting the voltage V developed across said electric motor of the air blower, and for generating a voltage signal corresponding to said voltage V;

memory means connected with said air temperature detector means, said current detector means, and said voltage detector means, for memorizing a value $T_o$ of said air temperature T at a time point just after a completion of a defrosting operation of said defrostor, a value $I_o$ of said current I at said time point, and a value $V_o$ of said voltage V at said time point;

ratio setting means for setting and memorizing a ratio K;

temperature difference setting means for setting and memorizing a temperature difference threshold value $\alpha$° C.;

calculator means connected with said air temperature detector means, said current detector means, said voltage detector means, said memory means, said ratio setting means, and said temperature difference setting means, for continuously determining whether or not the relation $I_o \times K \leqq I \times (V/V_o) \times (273+T)/(273+T_o)$ holds, and means for generating a first signal when said inequality $I_o \times K \leqq I \times (V/V_o) \times (273+T)/(273+T_o)$ holds, said calculator means further including means for continuously calculating the temperature difference (T−S), and for comparing said value $\alpha$ with said temperature difference (T−S), and means for generating a second signal when $\alpha \leqq (T-S)$ holds, said calculator means further including means for generating a defrostor activation signal for activating said defrostor means when both first and second signals are generated.

6. A frost detector for detecting a deposition of frost on an air cooler disposed in a refrigerating chamber, and for generating a defrostor activation signal when the amount of the deposition of frost reaches a predetermined level, said air cooler including piping means through which a medium flows depriving heat therefrom, air flower means for circulating air in said chamber past said piping means, an electric motor which drives said air flower means, and a defrostor means for removing frost deposited on said piping means, said frost detector comprising:

air temperature detector means for detecting the temperature T° C. of the air in said chamber, and for generating an air temperature signal corresponding to the air temperature T° C.;

piping temperature detecting means for detecting the temperature S° C. of said piping means, and for generating a piping temperature signal corresponding to the piping temperature S° C.;

current detector means for detecting the current I flowing through said electric motor of said air cooler, and for generating a current signal corresponding to said current I;

voltage detector means for detecting the voltage V developed across said electric motor of the air blower, and for generating a voltage signal corresponding to said voltage V;

memory means connected with said air temperature detector means, said current detector means, and said voltage detector means, for memorizing a value $T_o$ of said air temperature T at a time point just after a completion of a defrosting operation of said defrostor, a value $I_o$ of said current I at said time point, and a value $V_o$ of said voltage V at said time point;

temperature difference setting means for setting and memorizing a temperature difference threshold value $\alpha$° C.;

first calculator means connected with said air temperature detector means, said current detector means, said voltage detector means, and said memory means, for continuously calculating an adjusted current value which corresponds to said current I adjusted with respect to a variation of said voltage V from said value $V_o$ and with respect to a variation of said air temperature T with respect to said value $T_o$, said first calculator means including means for continuously determining whether or not said adjusted current value reaches a threshold value which is proportional to said value $I_o$ of said current, means for generating a first signal when said adjusted current value reaches said threshold value, and means for generating a first signal when said inequality $I_o \times K \leqq I \times (V/V_o) \times (273+T)/(273+T_o)$ holds;

second calculator means connected with said air temperature detector means, said piping temperature detector means, and said temperature difference setting means, for calculating the temperature difference $(T-S)$, and for comparing said value $\alpha$ with said temperature difference $(T-S)$, said second calculator means including means for generating a second signal when $\alpha \leqq (T-S)$ holds;

a third calculator means connected with said first and second calculation means, responsive to said first and second signals, for generating a defrostor activation signal for activating said defrostor means when both said first and second signals are generated.

7. A frost detector as claimed in claim 5 or 6, for detecting a deposition of frost on an air cooler disposed in a refrigerating chamber, and for generating a defrostor activation signal when the amount of the deposition of frost reaches a predetermined level, said air cooler including piping means through which a medium flows and deprives heat from the piping means, an expansion valve upstream of said piping means, air blower means for circulating air in said chamber past said piping means, an electric motor which drives said air blower means, and a defrostor means for removing frost deposited on said piping means, wherein said piping temperature detector means includes means for detecting the temperature S° C. of said medium at an outlet portion of said expansion valve.

8. A frost detector as claim in 5, wherein said calculator means includes means for calculating the product $I_o \times K$ and the adjusted current value $I \times (V/V_o) \times (273+T)/(273+T_o)$, means comparing said product and said adjusted current value, and means for generating first signal when the enequality $I_o \times K \leqq I \times (V/V_o) \times (273+T)/(273+T_o)$ holds.

9. A frost detector as claimed in claim 5, wherein said first calculator means includes means for calculating $(I/I_o) \times (V/V_o) \times (273+T)/(273+T_o)$, means for comparing said ratio K with $(I/I_o) \times (V/V_o) \times (273+T)/(273+T_o)$, and means for generating the first signal when the relation $K \leqq (I/I_o) \times (V/V_o) \times (273+T)/(273+T_o)$ holds.

* * * * *